US006059154A

United States Patent [19]

Bigotte et al.

[11] Patent Number: 6,059,154

[45] Date of Patent: May 9, 2000

[54] STOPPING CAPSULE INCORPORATING A SELF-RETRACTING SPOUT

[75] Inventors: François Bigotte, Moelan S/Mer; Christian Tatin, Larmor, both of France

[73] Assignee: Niob Plastique, France

[21] Appl. No.: 09/112,568

[22] Filed: Jul. 9, 1998

[30] Foreign Application Priority Data

Jul. 11, 1997 [FR] France ..... 97 08855

[51] Int. Cl.[7] ..... B67D 3/00; B67D 5/06

[52] U.S. Cl. ..... 222/507; 222/528; 222/530; 222/534

[58] Field of Search ..... 222/507, 212, 222/153.04, 153.13, 206, 215, 528, 529, 538, 533, 549

[56] References Cited

U.S. PATENT DOCUMENTS

| | | | |
|---|---|---|---|
| 3,094,255 | 6/1963 | Hunter | 222/507 |
| 3,278,095 | 10/1966 | Johns | 222/507 |
| 3,371,827 | 3/1968 | Micallef | 222/507 |
| 3,847,313 | 11/1974 | Micallef | 222/538 |
| 4,591,079 | 5/1986 | Bigotte | 222/538 |
| 4,779,773 | 10/1988 | Bennett | 222/507 |
| 4,998,649 | 3/1991 | Thanisch | 222/507 |
| 5,085,347 | 2/1992 | Hayes et al. | 222/534 |
| 5,203,841 | 4/1993 | Kitabayashi | 222/534 |

FOREIGN PATENT DOCUMENTS

| | | | |
|---|---|---|---|
| 1237513 | 6/1960 | France | 222/507 |

*Primary Examiner*—Gregory L. Huson
*Assistant Examiner*—Keats Quinalty
*Attorney, Agent, or Firm*—Ostrolenk, Faber, Gerb & Soffen, LLP

[57] ABSTRACT

The invention relates to a stopping capsule with self-retracting spout which comprises a capsule body with a central orifice, a mobile spout and a rotating lid which controls the emergence and retraction of the spout. The capsule body comprises a shaft which communicates with the spout by a supple, elastically deformable, hollow body, and the lid comprises a sleeve fitted in the shaft and presenting a lateral hole capable of being opposite the pipe of the spout.

9 Claims, 4 Drawing Sheets

STOPPING CAPSULE INCORPORATING A SELF-RETRACTING SPOUT

FIELD OF THE INVENTION

The invention relates to a capsule incorporating a self-retracting spout for stopping recipients such as tubes and flasks made of plastic, glass or metal.

More precisely, it relates to a stopping capsule of the type comprising a cylindrical capsule body presenting a central orifice opening out in an end face of said body, a spout mounted on the capsule body, so as to be mobile in a plane perpendicular to the axis of the central orifice, a pipe arranged in the spout, capable of being in communication with the central orifice of the capsule body in the position of use of said capsule, a rotating lid covering the capsule body and the spout and presenting a lateral window through which the front of the spout emerges when said capsule is in position of use, and means for displacing the spout with respect to the capsule body during rotation of the lid.

BACKGROUND OF THE INVENTION

Such a capsule is disclosed in FR-A-2 548 628, which provides that the spout be mounted to slide in a groove provided in the end face of the capsule body. The pipe of the spout comprises a vertical portion which is in line with the central orifice of the capsule body when the capsule is in position of use. To ensure tightness between the capsule body and the spout, an O-ring is provided around the central orifice of the capsule body, and the spout is pressed on the bottom of the groove by a hemispherical portion provided in the middle of the plate of the lid and directed downwardly. This capsule comprises three parts, and there are problems of tightness between the capsule body and the spout during use of the capsule and when the spout is retracted in the lid.

It is an object of the present invention to produce a capsule composed of two parts and to overcome the problems of tightness between the capsule body and the spout.

SUMMARY OF THE INVENTION

The invention attains this object in that:

a) the capsule body presents on its end face a hollow, cylindrical shaft which defines the central orifice, b) the spout is joined to said shaft by an elastically deformable supple body, c) the pipe communicates with the interior of the shaft by a conduit made in the supple body and the wall of the shaft, d) the lid comprises a cylindrical axial sleeve which fits inside the shaft and which presents a lateral hole provided to be opposite the conduit made in the wall of the shaft when said capsule is in position of use.

According to a first embodiment of the invention, the supple body is made in the form of bellows and the spout is mobile radially.

In this first embodiment, the means for radially displacing the spout comprise a catch formed on the spout and extending parallel to the axis of the central orifice and a guide ramp fast with the lid and cooperating with said catch during rotation of the lid.

The guide ramp is fast with the central plate of the lid and extends circumferentially from the periphery of the lid towards the centre, its shape being such that, by rotation of the lid towards the position of use, the spout remains firstly immobile with respect to the capsule body, until the front of the spout is entirely visible through the window and then moves axially until the front of the spout emerges through the window.

In the first phase of rotation of the lid towards the position of use, the front of the spout is adjacent a peripheral wall portion of the lid.

According to a second embodiment of the invention, the supple body is made in the form of a hollow flexible pipe and the spout pivots during rotation of the lid about a median portion of said flexible pipe.

In this second embodiment, the means for pivoting the spout comprise a vertical catch formed on the central plate of the lid and abutting on a lateral face of the spout.

The end face of the capsule body comprises axial stop walls in order to limit pivoting of the spout.

The axial stop walls are shaped as a two-armed square of which one arm obturates the pipe of the spout when the spout is in retracted position.

BRIEF DESCRIPTION OF THE DRAWINGS

The invention will be more readily understood on reading the following description with reference to the accompanying drawings, in which.

DESCRIPTION OF PREFERRED EMBODIMENTS

Figure 1:
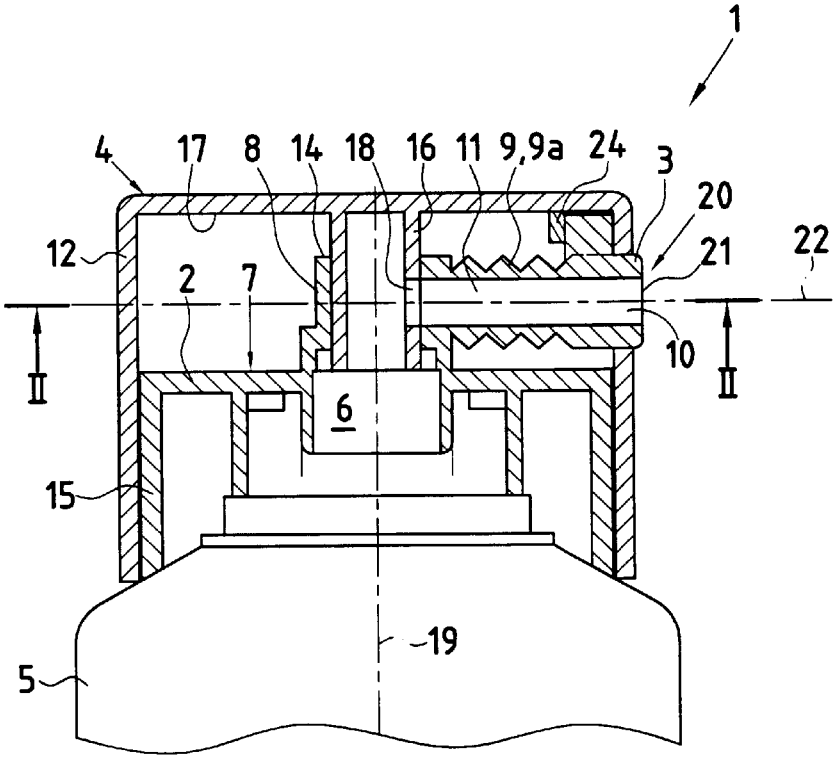
FIG. 1 is an axial section, along line I—I of FIG. 2, of the capsule according to a first embodiment of the invention, this capsule being in position of use.

Referring now to the drawings, the Figures show a stopping capsule 1 incorporating a spout, which comprises a capsule body 2 equipped with a spout 3 and a rotating lid 4 covering the capsule body 2 and the spout 3.

The capsule body 2 fits on the upper end of a recipient 5 or flask and comprises an axial central orifice 6 to ensure that the product contained in the recipient 5 can emerge.

As is particularly visible in FIGS. 1, 3, 5 and 7, the capsule body 2 presents on its upper end face 7 a cylindrical shaft 8 which defines the central orifice 6.

The spout 3 is connected to the shaft 8 by an elastically deformable, supple body 9 and it comprises a pipe 10 which is in communication with the interior of the shaft 8 via a conduit 11 made in the supple body 9 and the wall of the shaft 8.

The lid 4 comprises a cylindrical peripheral skirt 12 surmounted by a central plate 13 disposed above the end 14 of the shaft 8. The peripheral skirt 12 surrounds the peripheral wall 15 of the capsule body 2 and is clipped on said wall by means of annular grooves and flutes (not shown in the drawing).

A cylindrical sleeve 16 is formed on the lower face 17 of the central plate 13. This sleeve 16 fits inside the shaft 8 and it presents a lateral hole 18 which may be opposite the orifice of the conduit 11 in order to deliver product contained in the recipient 5 via the pipe 10 of the spout 3 further to rotation of the lid 3 around the axis 19 which is common to the sleeve 16, the shaft 8, the skirt 12 and the peripheral wall 15 of the capsule body 2.

The lid 4 further comprises a lateral window 20 through which the front end 21 of the spout 3 emerges when the lateral hole 18 of the cylindrical sleeve 16 is opposite the orifice of the conduit 11.

The capsule 1 further comprises means for retracting the spout 3 inside the lid 4, by rotation of the lid 4 around axis 19.

In accordance with a first embodiment shown in FIGS. 1 to 4, the supple body 9 which joins the spout 3 to the shaft 8 is in the form of bellows 9*a* capable of expanding or contracting in the direction of axis 22 of the pipe 10 and of the conduit 11. To that end, the spout 3 comprises a catch 23 parallel to axis of rotation 19 which cooperates with a guide ramp 24 formed on the lower face 17 of the lid plate 13.

Figure 2:
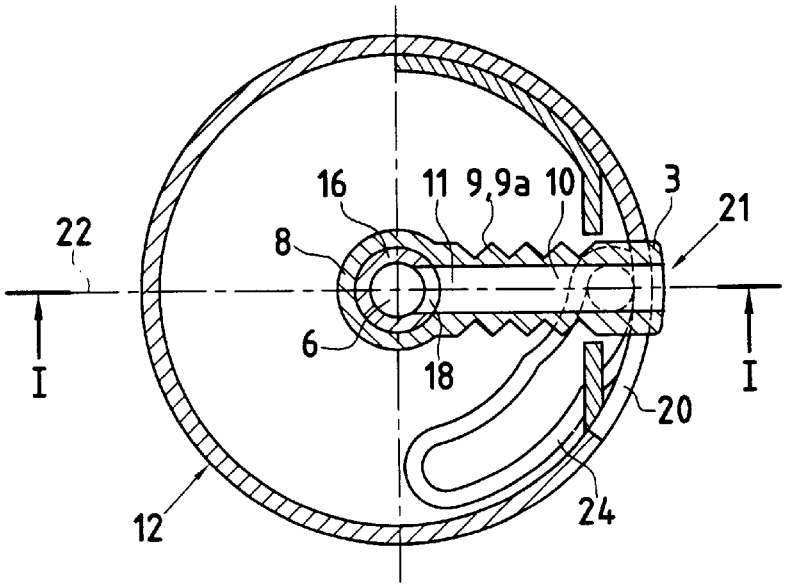
FIG. 2 is a transverse section along line II—II of FIG. 1 of the capsule in position of use.
Figure 3:
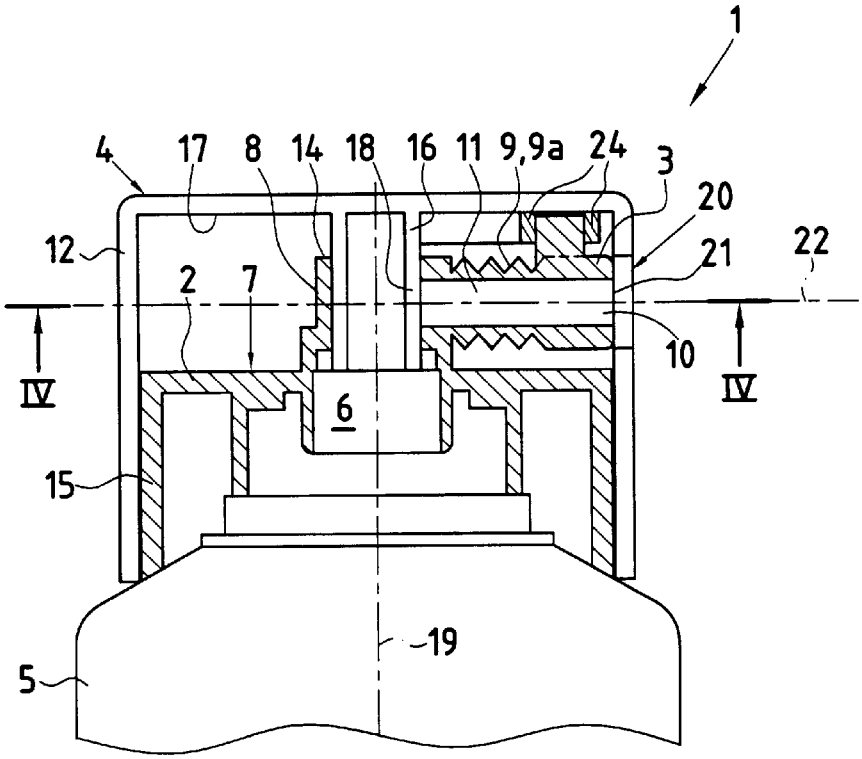
FIG. 3 is an axial section along line III—III of FIG. 4, of the capsule according to the first embodiment, this capsule being in closed position.
Figure 4:
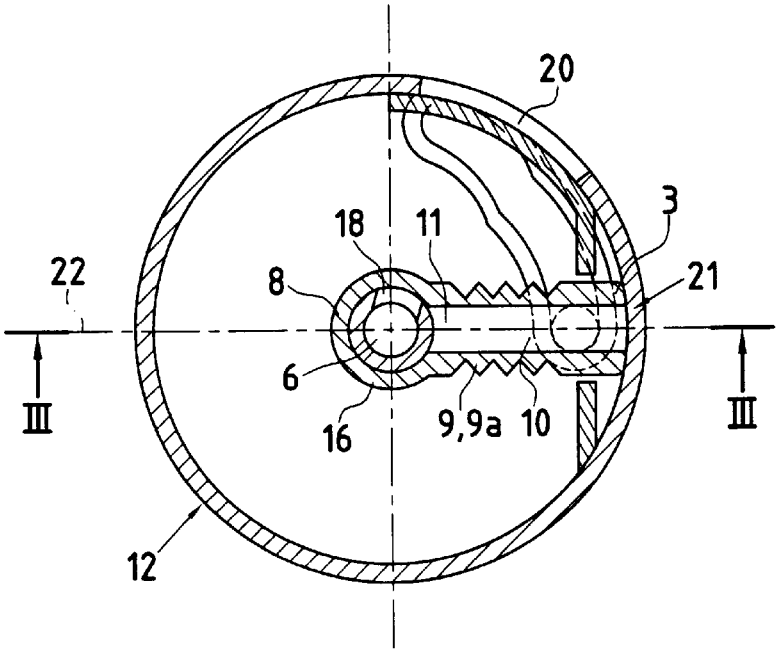
FIG. 4 is a transverse section along line IV—IV of FIG. 3.
Figure 5:
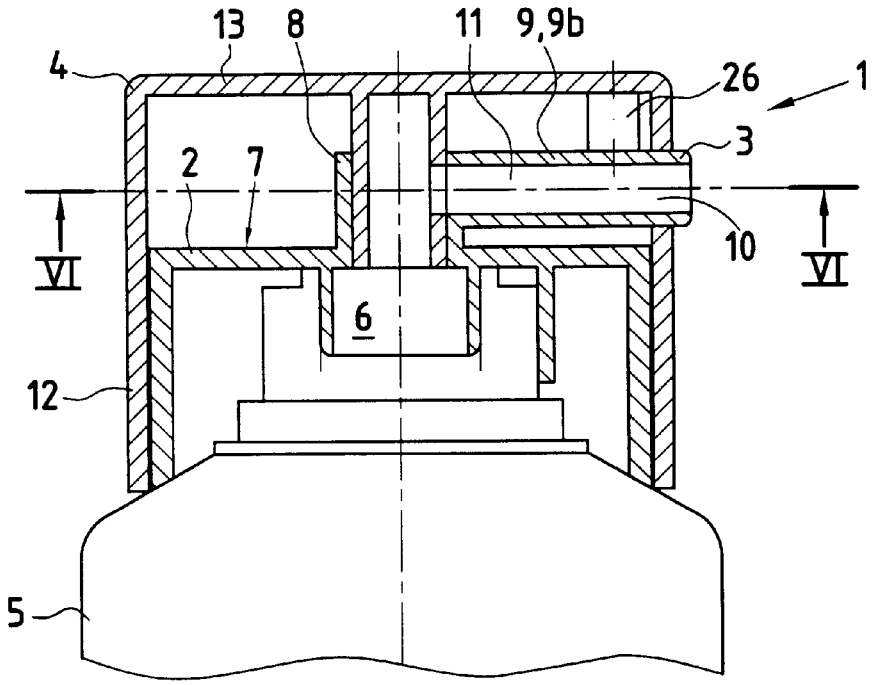
FIG. 5 shows a second embodiment of the capsule of the invention in an axial section taken along line V—V of FIG. 6, in position of use.
Figure 6:
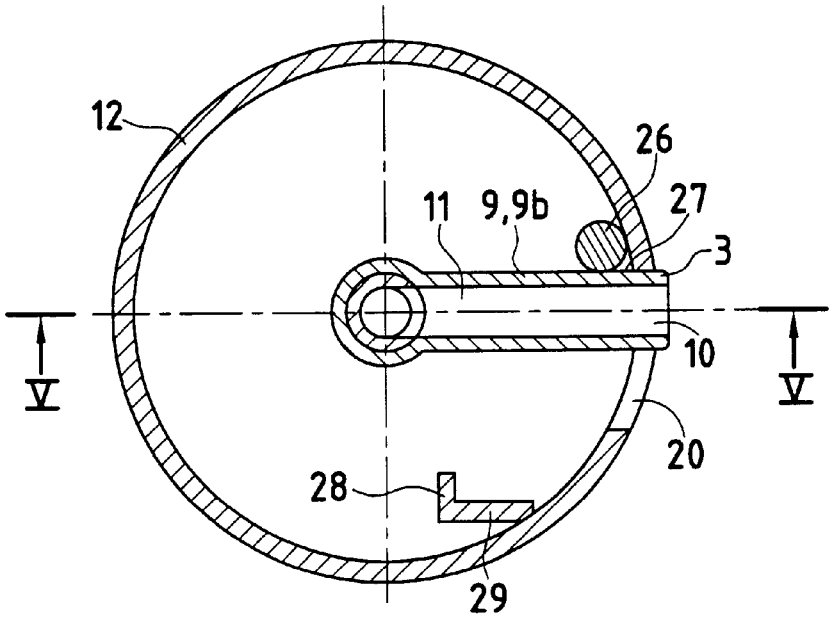
FIG. 6 is a transverse section along line VI—VI of FIG. 5.
Figure 7:
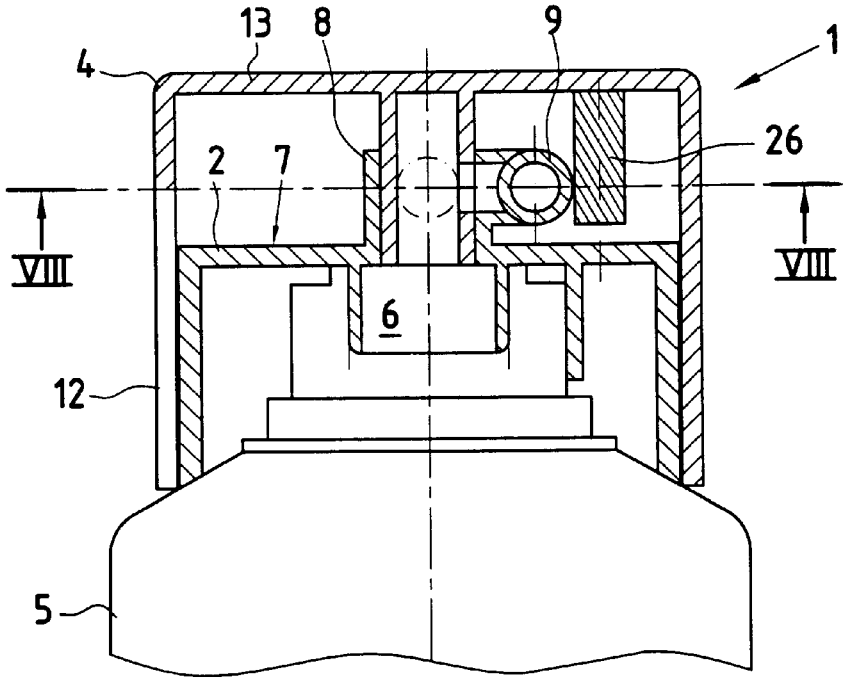
FIG. 7 shows the capsule of FIG. 5 in closed position, in axial section along line VII—VII of FIG. 8, the spout being retracted.

As is particularly visible in FIGS. 2 and 4, the guide ramp 24 extends circumferentially around the axis of rotation 19 and its shape is such that, when the lid 4 is rotated from the extreme retracted position (FIG. 4) of the spout 3 towards the position of use (FIG. 2), the spout 3 firstly remains immobile with respect to the capsule body 2 until the front 21 of the spout 3 is totally visible through the window 20, and then moves axially until the front 21 of the spout 3 emerges through window 20.

In the retracted position of the spout 3, the front end 21 is preferably in the immediate vicinity of the inner wall of the skirt 12 in order to avoid contact between the atmosphere and the product contained in the pipe 10.

Figure 8:
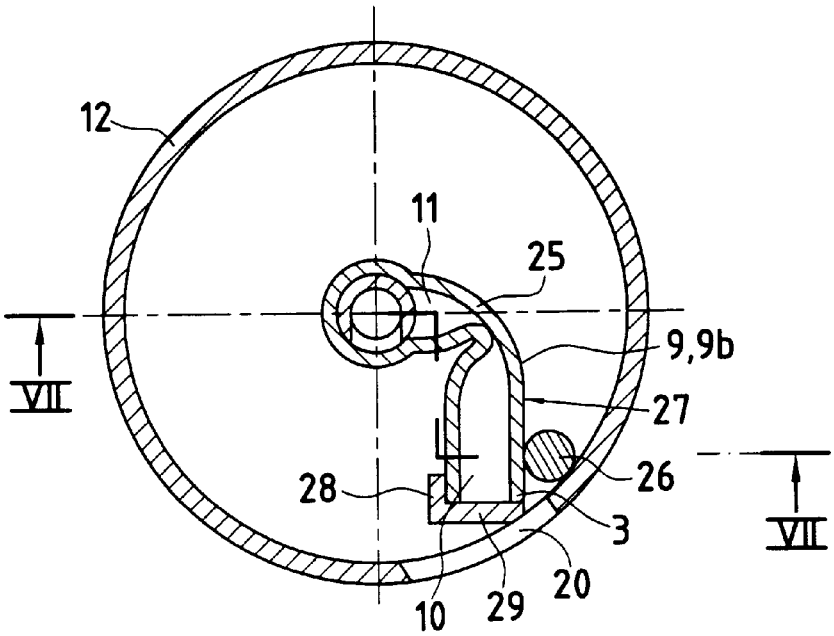
FIG. 8 is a transverse section along line VIII—VIII of FIG. 7 which shows the spout in retracted position.

In accordance with a second embodiment shown in FIGS. 5 to 8, the supple body 8 is in the form of a hollow flexible tube 9*b* and the spout 3 pivots at the level of the median portion 25 of the tube around an axis parallel to the axis of rotation 19, during rotation of the lid 4. This latter comprises on the lower face 17 of the plate 13 a vertical catch 26 which comes into abutment in order to retract the spout 3 by pivoting. Stop walls 28, 29 forming a square are formed on the upper face 7 of the capsule body 2. These walls 28, 29 are intended to limit the displacement of the lid 4 when the spout 3 is retracted. When the capsule 1 is in closed position, as shown in FIG. 8, the front end 21 of the spout 3 is in the inmmediate vicinity of the wall 29, which obturates the pipe 10 when the spout 3 is in retracted position.

When the capsule 1 is in the closed position, as shown in FIGS. 4 and 8, communication between the conduit 11 and the central orifice 6 is obturated by the cylindrical sleeve 16, and the outlet orifice of the pipe 10 is obturated either by the skirt 12 of the lid 4 in the first embodiment, or by the wall 29, in the second embodiment.

What is claimed is:

1. Stopping capsule incorporating a self-retracting spout, comprising a cylindrical capsule body presenting a central orifice opening out in an end face of said body, a spout mounted on the capsule body, so as to be mobile in a plane perpendicular to the axis of the central orifice, a pipe arranged in the spout, capable of being in communication with the central orifice of the capsule body in the position of use of said capsule, a rotating lid covering the capsule body and the spout and presenting a lateral window through which the front of the spout emerges when said capsule is in position of use, and means for displacing the spout with respect to the capsule body during rotation of the lid wherein:

a) the capsule body presents on its end face a hollow, cylindrical shaft which defines the central orifice, b) the spout is joined to said shaft by an elastically deformable supple body, c) the pipe communicates with the interior of the shaft by a conduit made in the supple body and the wall of the shaft, d) the lid comprises a cylindrical axial sleeve which fits inside the shaft and which presents a lateral hole provided to be opposite the conduit made in the wall of the shaft when said capsule is in position of use.

2. The capsule of claim 1, wherein the supple body is made in the form of bellows and the spout is mobile radially.

3. The capsule of claim 2, wherein the means for radially displacing the spout comprise a catch formed on the spout and extending parallel to the axis of the central orifice and a guide ramp fast with the lid and cooperating with said catch during rotation of the lid.

4. The capsule of claim 3, wherein the guide ramp is fast with the central plate of the lid and extends circumferentially from the periphery of the lid towards the centre, its shape being such that, by rotation of the lid towards the position of use, the spout remains firstly immobile with respect to the capsule body, until the front of the spout is entirely visible through the window, and then moves axially until the front of the spout emerges through the window.

5. The capsule of claim 4, wherein, in the first phase of rotation of the lid towards the position of use, the front of the spout is adjacent a peripheral wall portion of the lid.

6. The capsule of claim 5, wherein the means for pivoting the spout comprise a vertical catch formed on the central plate of the lid and abutting on a lateral face of the spout.

7. The capsule of claim 1, wherein the supple body is made in the form of a hollow flexible pipe and the spout pivots during rotation of the lid about a median portion of said flexible pipe.

8. The capsule of claim 7, wherein the end face of the capsule body comprises axial stop walls in order to limit pivoting of the spout.

9. The capsule of claim 8, wherein the axial stop walls are shaped as a two-armed square of which one arm obturates the pipe of the spout when the spout is in retracted position.

* * * * *